US005746235A

United States Patent [19]

Lin

[11] Patent Number: 5,746,235

[45] Date of Patent: May 5, 1998

[54] LINKAGE DEVICE FOR AN UMBRELLA

[75] Inventor: Yao-Chin Lin, Tainan, Taiwan

[73] Assignee: Asia Umbrella Industries Co., Ltd., Tainan, Taiwan

[21] Appl. No.: 838,144

[22] Filed: Apr. 14, 1997

[51] Int. Cl.[6] ..... A45B 25/00

[52] U.S. Cl. ..... 135/29; 135/32

[58] Field of Search ..... 135/29, 30, 31, 135/32, 27, 25.1, 25.31, 25.34

[56] References Cited

U.S. PATENT DOCUMENTS

| | | | |
|---|---|---|---|
| 4,368,749 | 1/1983 | Lindler et al. | 135/30 X |
| 5,121,764 | 6/1992 | Wu | 135/31 |
| 5,193,566 | 3/1993 | Chen | 135/29 X |
| 5,323,801 | 6/1994 | Kuo | 135/31 X |
| 5,372,155 | 12/1994 | You | 135/29 |

FOREIGN PATENT DOCUMENTS

| | | | |
|---|---|---|---|
| 1113067 | 8/1961 | Germany | 135/29 |
| 764795 | 1/1957 | United Kingdom | 135/29 |

*Primary Examiner*—Lanna Mai
*Attorney, Agent, or Firm*—Oppenheimer Poms Smith

[57] ABSTRACT

A linkage device for an umbrella includes a pivot and a joint. A frame having an opening defined therein is integrally formed on a periphery of the pivot. A deformable leaf is provided to the joint and has a configuration to mate with a recess defined in the joint. Furthermore, a pivot rod is provided to the joint and functions as a pivot when the stretchers and the ribs are expand or folded. Therefore, when a portion of the frame is received within the joint, the deformable leaf is able to securely enclose the portion of the frame within the joint.

4 Claims, 6 Drawing Sheets

LINKAGE DEVICE FOR AN UMBRELLA

FIELD OF THE INVENTION

The present invention generally relates to a linkage device, and more particularly to a linkage device for an umbrella. The linkage device enables the umbrella to be assembled easily yet still have a durable structure.

BACKGROUND OF THE INVENTION

To reduce the weight of, simplify and strengthen the structure of an umbrella, nowadays, most ribs and stretchers thereof are made of Fiber Reinforced Plastic (FRP). A partial structure of a conventional umbrella is shown in FIGS. 6 and 7. The umbrella comprises a main post 90, a plurality of ribs 60 and a plurality of stretchers 74. One end of each rib 60 is pivotally connected with a distal end of the main post 90 via a first of a plurality of joints 70. Each stretcher 74 is also pivotally connected with a respective rib 60 via a second of the joint 70 and a pivot 50 and with the main post 90 via a third of the joints 70 pivotally connected with a runner 80 which is slidably disposed onto the main post 90. That is, two distal ends of each of the stretchers 74 are pivotally connected between each of the ribs 60 and the runner 80 via respective second and third joints 70. Therefore, the ribs 60 of the umbrella are able to be pushed outward or retracted by the upward/downward movement of the runner 80 along the main post 90.

Referring to FIGS. 7 and 8, detailed description of the structure of the pivot 50 and the joint 70 is as follows. The pivot 50 is configured to have a tube having two closly spaced wings 52 securely formed and correspondingly arranged on a periphery thereof. Each wing 52 has a through hole 53 defined therein and aligned with each other, such that a rivet 54 can extend therethrough. The joint 70 is configured to have a first open end (not numbered) and a flat extension 72 having a hole 73 defined therein and formed on the second end thereof. The flat extension 72 of the joint 70 is then disposed between the two wings 52 and the hole 73 of the extension 72 is aligned with the respective through hole 53 of the wings 52, such that the rivet 54 is able to securely yet pivotally connect the stretcher 74 with the pivot 50 when extending through the through hole 53 and the hole 73.

Having such a configuration and assembly, it is necessary to have a worker move the flat extension 72 into the space between the two wings 52 and rivet them together. During the above mentioned process, carrying parts from one place to another is too time consuming and since the size of the rivet itself is so small, it is very difficult for a worker to respectively insert them into the through hole 53 and the hole 73 precisely. Another disadvantage is that after a long period of time, the rivet 54 will gradually rust, and the shear force caused by the opening and closing of the umbrella will break the rusting rivet 54. FIG. 8 especially shows the relationship between the rivet 54 and the pivot 50 and the joint 70. When the runner 80 moves upward/downward the shear force between the hole 73 of the extension and the rivet 54 will result in a negative influence to the quality of the umbrella.

From the previous description, the umbrellas currently available in the market which have a linkage device to control the expansion/folding of the stretchers are not able to fulfill the needs of users and improvements or alternations thereof are thus required. A linkage device constructed in accordance with the present invention tends to mitigate and/or obviate the aforementioned problems.

SUMMARY OF THE INVENTION

The main objective of the invention is to provide a linkage device to respectively control the expansion or folding of the ribs and the stretchers. The linkage device is constructed to have a pivot provided with a frame and a joint provided with a foldable leaf and a positioning rod, such that after the foldable leaf is inserted into the frame of the pivot, the foldable leaf is thus closed to enclose a portion of the frame by means of the insertion of the positioning rod into a hole defined in the foldable leaf, which is easily accomplished.

Another objective of the invention is to provide a linkage device, wherein the frame of the pivot is configured to have thick wall corresponding to the positioning rod having a large diameter, so that the linkage device will have a larger contact area than the prior ones between the positioning rod and the frame to increase the stability between the pivot and the joint.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
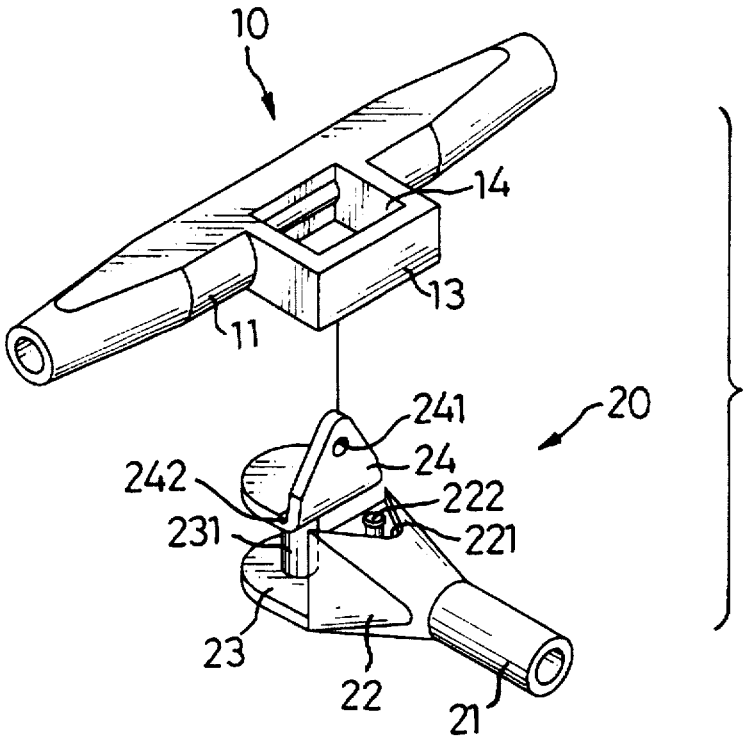
FIG. 1 is a perspective exploded view of a linkage device constructed in accordance with the present invention.

Referring to FIG. 1, one preferred embodiment of a linkage device constructed in accordance with the present invention is shown. The linkage device comprises a pivot 10 and a joint 20. The pivot 10 is configured to have elongate tube 11 and a frame 13 integrally formed on a periphery of the elongate tube 11 and having an opening 14 defined therein. The joint 20 is configured to have a receiving seat 21 having a configuration in corresponding to a shape of a stretcher (not shown), thereby allowing the stretcher to be securely received therein, a body 22 integrally formed with an end of the receiving seat 21 and having a recess 221 defined therein, an extension 23 integrally extending out from a bottom of the body 22, a pivot rod 231 extending upward from a top face of the extension 23 and a deformable leaf 24 having a through hole 241 defined therein and a crease 242 formed thereon. A positioning rod 222 extends upward from the recess 221 of the body 22 and is positioned in alignment with the through hole 241 of the deformable leaf 24. The recess 221 is so defined in the body 22 that when the positioning rod 222 extends into the through hole 241 of the deformable leaf 24, a top face (not shown) of the deformable leaf 24 is flush with a face of the body 22.

Figure 2:
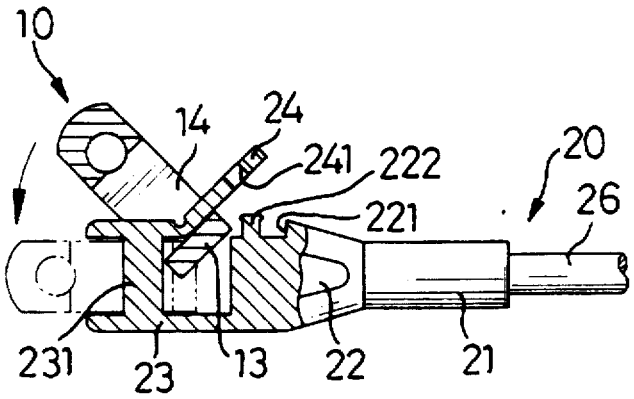
FIG. 2 is a schematic view showing that a pivot is about to be pivotally connected with a joint.
Figure 3:
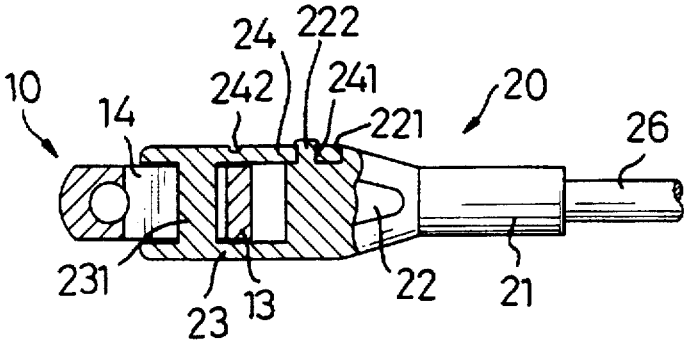
FIG. 3 is a partial cross sectional view showing that the pivot and the joint are pivotally connected and a foldable leaf of the joint is closed to enclose a portion of a frame of the pivot.

Referring to FIGS. 2 and 3, it is to be noted that because of the opening 14 of the pivot 10 and a distance between the crease 242 and an end wall of the body 22, the deformable leaf 24 is able to extend through the opening 14 and the frame 13 is then received within the joint 20. When the frame 13 is received within the joint 20, the pivot 10 is moved in a direction in accordance with the indication of the arrow and then the deformable leaf 24 is moved downward to mate with the recess and the positioning rod 222 firmly extends into the through hole 241. After the positioning rod 222 has extended into the through hole 241, a top face of the deformable leaf 24 is flush with a face of the body 22.

Figure 4:
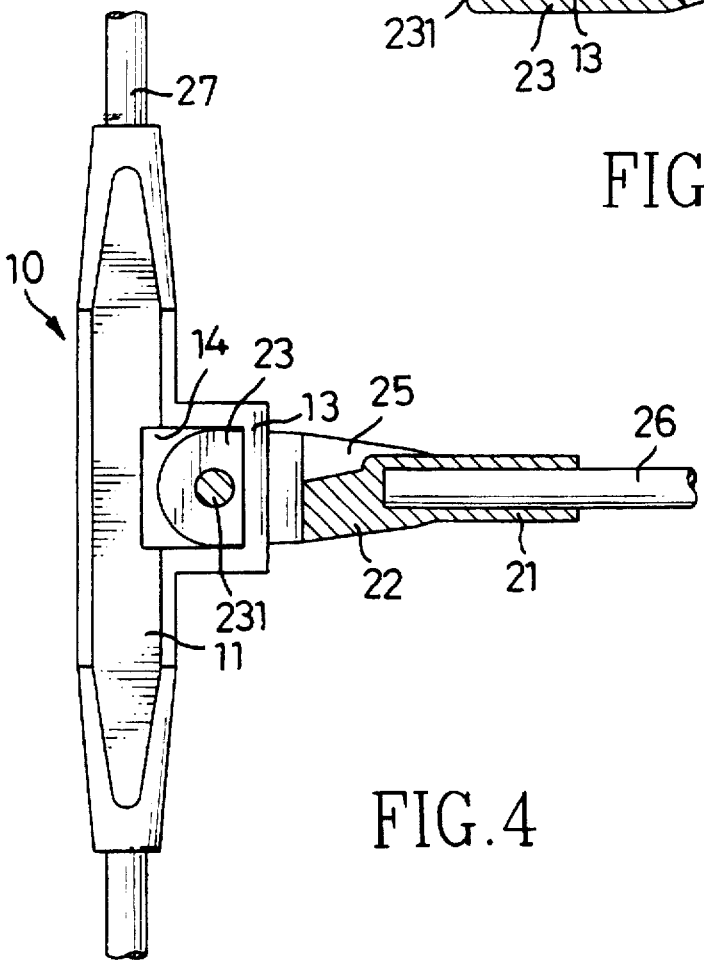
FIG. 4 is a top plan view partly in section of the present invention.

Referring to FIG. 4, a rib 27 is securely received within the elongate tube 11 and a stretcher 26 is also securely received within the receiving seat 21 of the joint 20. The pivot rod 231 of the joint 22 is able to pivot in relation to a wall of the frame 13 which provides a stable support to the pivot rod 231. Therefore, the umbrella having the linkage device of the present invention has a stronger structure and a more stable support to the ribs and the stretchers when the umbrella is expanded or folded.

Figure 5:
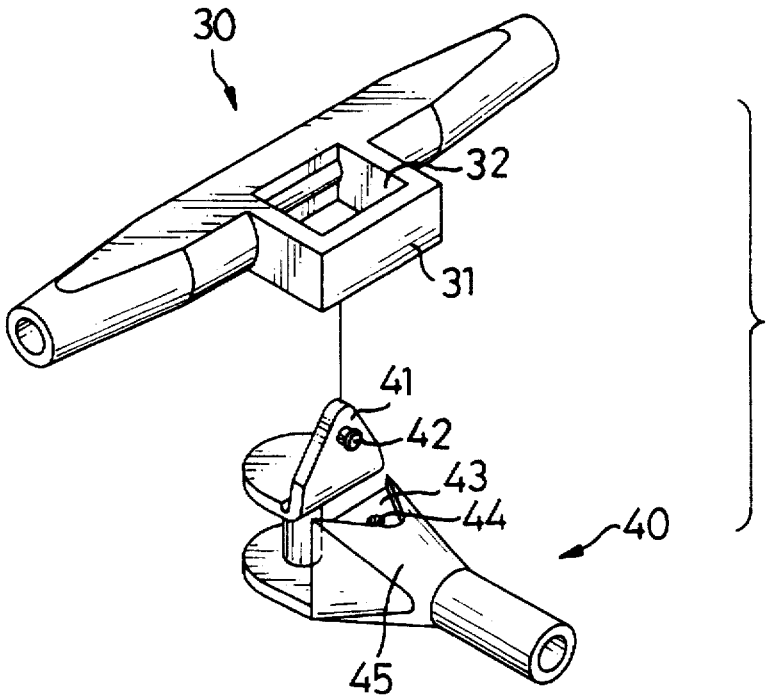
FIG. 5 is a further preferred embodiment of the present invention.
Figure 6:
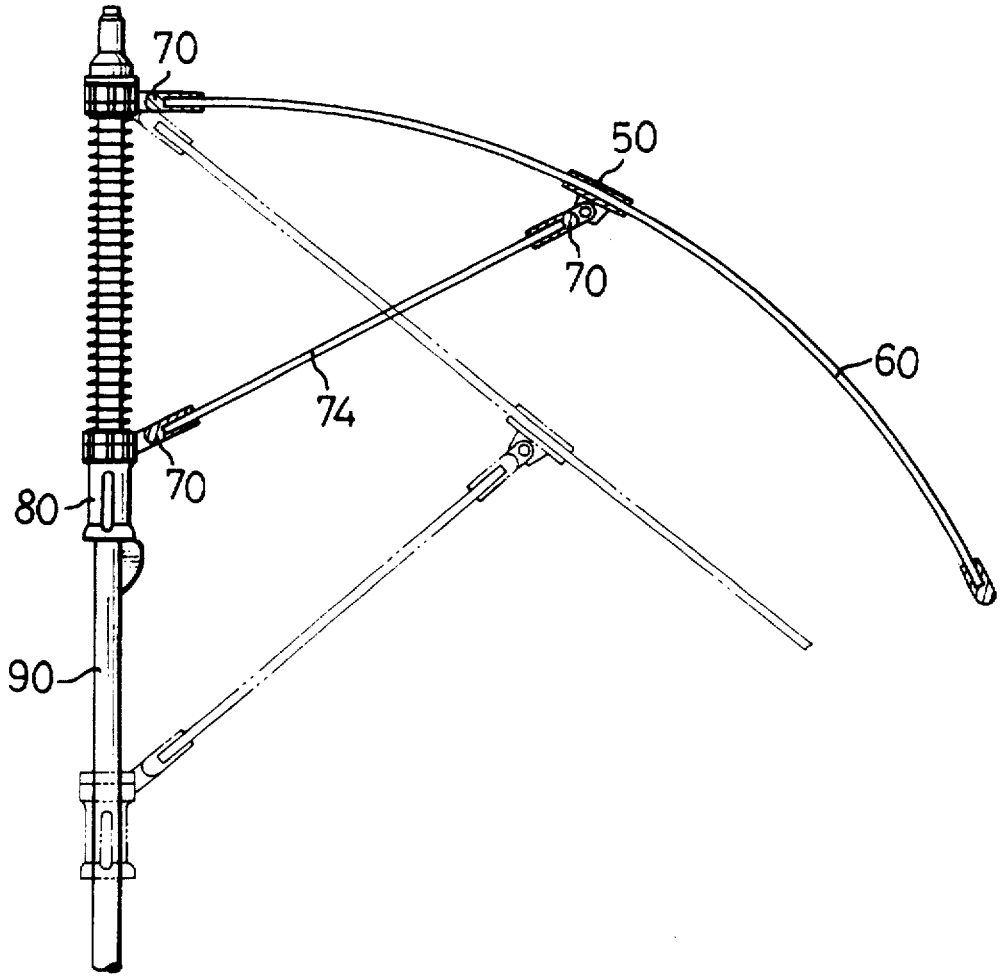
FIG.6 PRIOR ART
FIG. 6 is a schematic view showing the assembly of a conventional linkage device of an umbrella.
Figure 7:
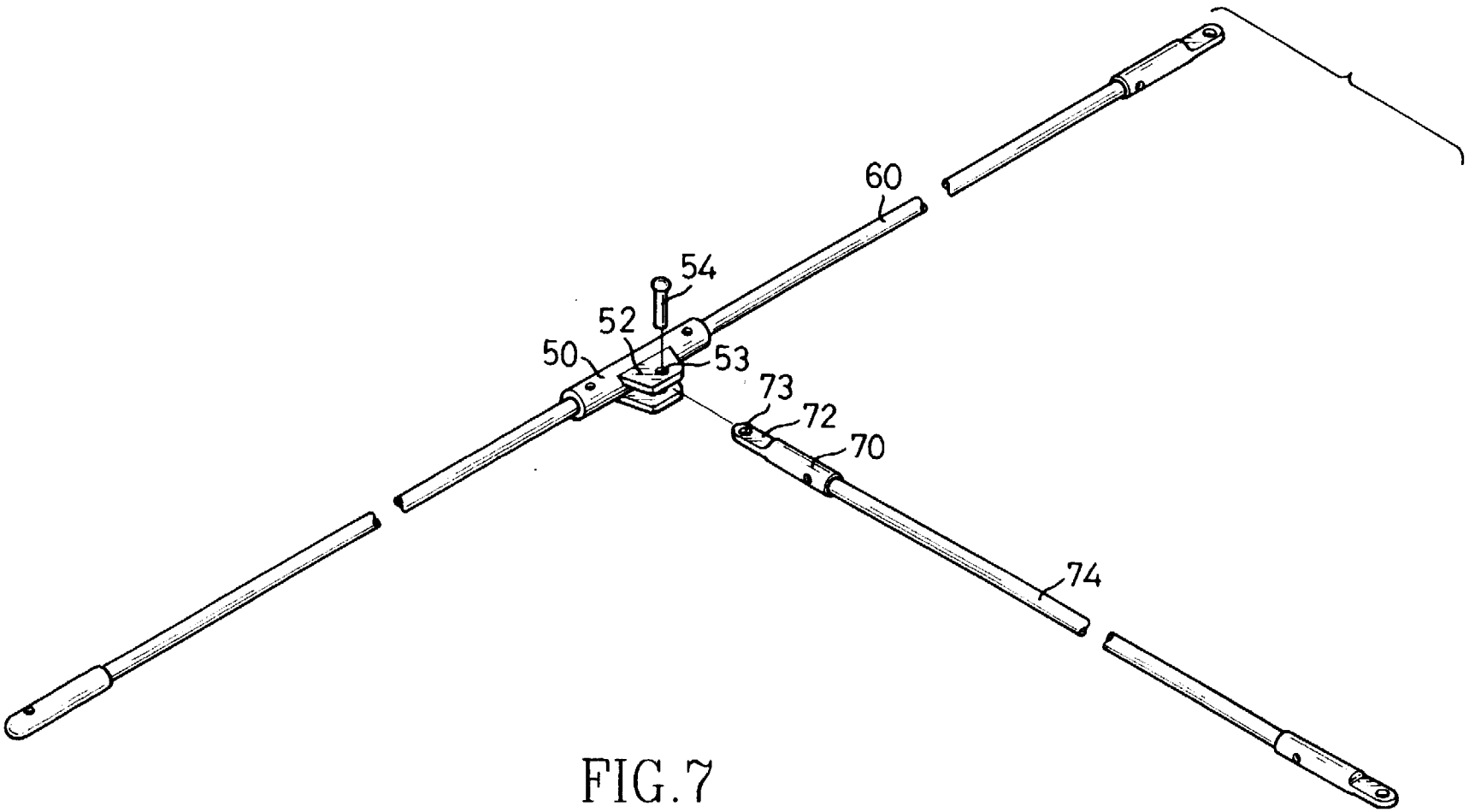
FIG. 7 PRIOR ART
FIG. 7 is an exploded view of the linkage device as shown in FIG. 6.
Figure 8:
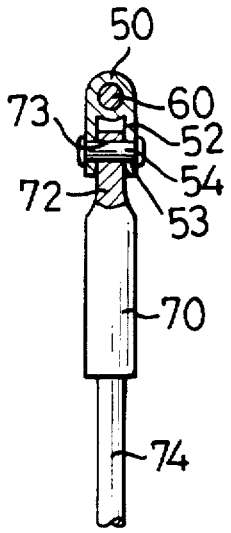
FIG.8 PRIOR ART
FIG. 8 is a side view of the linkage device, with partial in section, as shown in FIG. 6.

Referring to FIG. 5, another preferred embodiment of the present invention is shown. A pivot 30 is configured as the pivot 10 shown in the previous drawings. A joint 40 is configured basically the same as the joint 20 shown in the previous drawings. A deformable leaf 41 has a positioning rod 42 integrally formed thereon and a through hole 44 aligned with the positioning rod 42 is defined in a face defining a recess 43 of a body 45, such that when the deformable leaf 41 is folded to the recess 43, the positioning rod 42 is able to securely extend into the through hole 44. Therefore, when the deformable leaf 41 is extended through the opening 32 of the frame 31 and the frame 31 is received within the joint 40, the deformable leaf 41 is folded to have the positioning rod 42 securely extend into the through hole 44 of the joint 40. The thickness of the deformable leaf 41 and the depth of the recess 43 are so dimensioned that when the deformable leaf 41 is folded, a top face of the deformable leaf 41 is flush with an upper face of the body 45. The assembly of the linkage device of the present invention is thus completed.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A linkage member for an umbrella comprising:

a pivot having a tube for receiving a rib of said umbrella therethrough and a frame integrally formed on a periphery of said tube and defining therein an opening;

a joint having a receiving seat for receiving a stretcher of said umbrella therein, a body integrally formed with said receiving seat and defining in a face thereof a recess in which a positioning rod is provided, an extension integrally extending out from a bottom of said body, a pivot rod extending upward from said extension and a deformable leaf securely connected with a distal end of said pivot rod and defining therein a through hole aligned with said positioning rod, and a crease;

said deformable leaf being able to extend through said opening of said frame and having a portion of said frame received within said joint;

said deformable leaf being able to be folded and having said positioning rod extend into said through hole and thus securely maintaining said portion of said frame within said joint.

2. The linkage device as claimed in claim 1, wherein a portion of said deformable leaf is configured to mate with said recess of said body.

3. A linkage member for an umbrella comprising:

a pivot having a tube for receiving a rib of said umbrella therethrough and a frame integrally formed on a periphery of said tube and defining therein an opening;

a joint having a receiving seat for receiving a stretcher of said umbrella therein, a body integrally formed with said receiving seat and defining in a face thereof a recess in which a through hole is defined, an extension integrally extending out from a bottom of said body, a pivot rod extending upward from said extension and a deformable leaf securely connected with a distal end of said pivot rod and formed thereon a positioning rod aligned with said through hole and a crease;

said deformable leaf being able to extend through said opening of said frame and having a portion of said frame received within said joint;

said deformable leaf being able to be folded and having said positioning rod extend into said through hole and thus securely maintaining said portion of said frame within said joint.

4. The linkage device as claimed in claim 3, wherein a portion of said deformable leaf is configured to mate with said recess of said body.

* * * * *